United States Patent [19]

Nadler

[11] Patent Number: 4,598,344

[45] Date of Patent: Jul. 1, 1986

[54] ELONGATED LAMP, PARTICULARLY FLUORESCENT LAMP

[75] Inventor: Gerhard Nadler, Munich, Fed. Rep. of Germany

[73] Assignee: Patent-Treuhand Gesellschaft fur elektrische Glühlampen mbH, Munich, Fed. Rep. of Germany

[21] Appl. No.: 689,952

[22] Filed: Jan. 9, 1985

[30] Foreign Application Priority Data

Jan. 30, 1984 [DE] Fed. Rep. of Germany ... 8402555[U]

[51] Int. Cl.[4] ..... F21V 17/02

[52] U.S. Cl. ..... 362/220; 362/260; 362/282; 362/374

[58] Field of Search ..... 362/217, 220, 223, 260, 362/282, 216, 322, 374

[56] References Cited

U.S. PATENT DOCUMENTS

| | | | |
|---|---|---|---|
| 2,337,745 | 12/1943 | Garstang | 362/260 |
| 4,414,616 | 11/1983 | de Vos et al. | 362/223 |
| 4,454,569 | 6/1984 | Maguire | 362/220 |
| 4,489,368 | 12/1984 | Sangiamo et al. | 362/427 |

*Primary Examiner*—Andrew M. Dolinar

*Attorney, Agent, or Firm*—Frishauf, Holtz, Goodman & Woodward

[57] ABSTRACT

To permit selective direction of light from the reflector (9) associated with a single-ended fluorescent lamp (2), the reflector is secured in a separable housing part (4) for the fluorescent lamp (2) of which another housing part (3) retains the socket (2) to receive the base of the single-ended fluorescent lamp (2). The two housing parts (3, 4) can be snapped together in selected angular positions by interengaging, interlocking projection-and-recess connections.

7 Claims, 3 Drawing Figures

ELONGATED LAMP, PARTICULARLY FLUORESCENT LAMP

Reference to related patent, the disclosure of which is hereby incorporated by reference, assigned to the assignee of the present application: U.S. Pat. No. 4,481,442, Nov. 6, 1984, Albrecht et al.

The present invention relates to a lamp, which includes an elongated light source having a base at one end, for example a fluorescent lamp as described in the referenced U.S. Pat. No. 4,481,442, a socket for the lamp, and a lamp-shade which forms part of the light source housing. The lamp-shade includes a reflector.

BACKGROUND

Various lamps which include light source-lamp-shade combinations have been proposed. To direct the light, such lamp-shades frequently include reflector elements. If the lamp-shade-reflector combination is to direct the light into various positions, it is necessary to include a connection between the housing, which includes the socket, and the lamp, which is rotatable or movable. Such a connection, frequently, is undesirable since it may include sliding contacts and terminals, subject to malfunction and high assembly costs.

THE INVENTION

It is an object to provide a lamp in which the direction of light emitted from the light source can be readily controlled, which is simple to make, and efficient in use.

Briefly, a two-part housing is provided, the two-part housing being separable along a plane essentially transverse to the longitudinal extent, or general longitudinal axis of the elongated light source. The light source, preferably, is an elongated fluorescent lamp having its base at one end as described in the referenced U.S. Pat. No. 4,481,442, Albrecht et al., but it may be a different type of light source. The lamp projects from one part of the housing, which includes the socket for the lamp base. The second part of the housing is formed to cover, in part, the elongated light source, the reflector being formed or retained inside the second part. In accordance with a feature of the invention, the first and second parts are interlocked by connection means which, separably, permit placement of the second part which includes the reflector in at least two different angular positions about the light source, so that the direction of light reflected by the reflector from the light source can be changed as desired.

The lamp has the advantage that it can be easily made, and the light directed by the reflector, as desired, for example by snapping the second housing part, with the reflector, out of the first housing part, retaining the base of the lamp in its socket, from one position, and reversing the second housing part with the reflector; or, for example, reinserting the second housing part with the reflector at different interengaging positions, located at selected angles about the axis of the light source.

In accordance with a feature of the invention, the interengaging connection means are interlocks, for example plastic interengaging snap hooks, which snap into depressions, the hooks or depressions being formed, respectively, on the second and first housing parts, as desired.

The arrangement permits change of the direction in which light is reflected, for example by 180°. It is then no longer necessary to either construct the reflector with a rotary joint on the first housing part, or to construct rotary joints in the second housing part.

DETAILED DESCRIPTION

Figure 1:
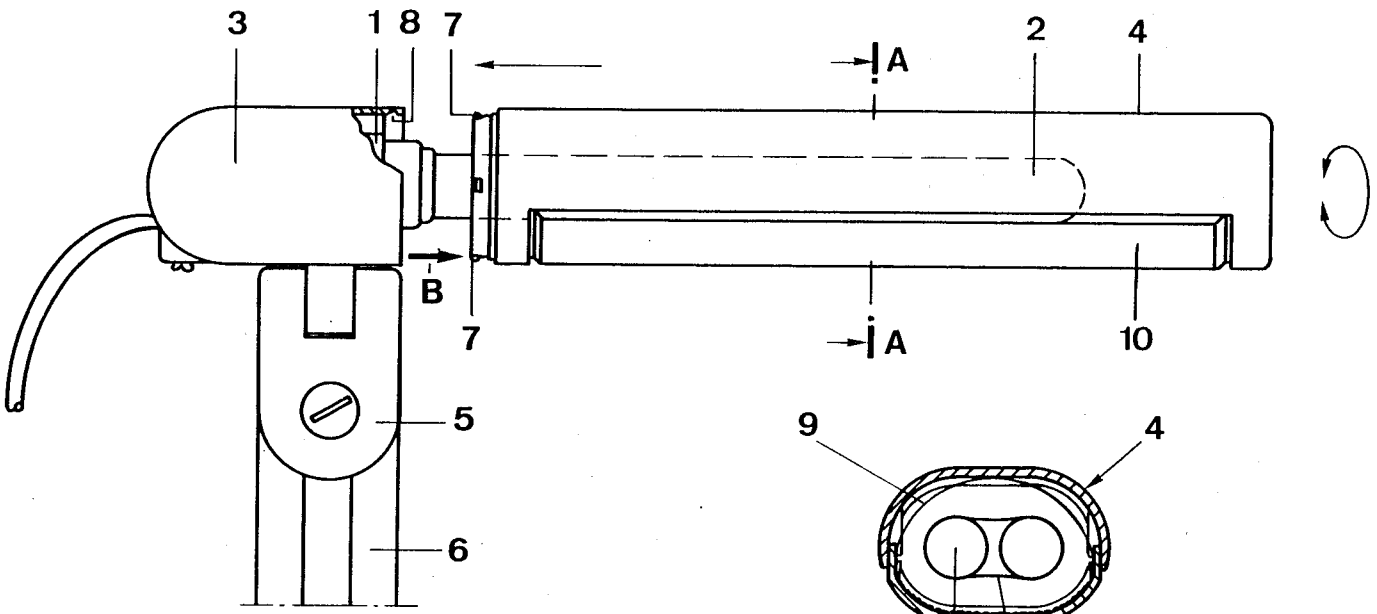
FIG. 1 is a side view of the lamp.

The light source has two elongated fluorescent tube sections 2 and a base, located at one end of the fluorescent tubes, together forming the light source. The housing has two parts 3, 4. The housing part 3, which retains the socket 1 for the base of the light source, is connectable by a double joint 5 with a holder 6. As illustrated, the combination is specifically suitable for use with a single-ended fluorescent lamp. The ballast usually needed to operate the fluorescent lamp can be combined with the connecting plug, connected to the power supply cable of the light source. The connecting plug and the ballast connection are not shown, since they are well known and can be in accordance with any suitable construction. Likewise, an ON/OFF switch for the lamp and the like has been omitted; it may be included within the cable to the lamp, for example.

In accordance with a feature of the invention, the two housing parts 3, 4 are interengaged by projections 7 formed on the housing part 4 which fit into grooves 8 formed on the housing part 3. The projections and grooves have small projecting bumps, in the form of small projecting hooks, so that the parts 3, 4 will interfit, and can be snapped together, yet are separable. FIG. 1 illustrates the housing part 4 removed from the housing part 3, so that the interengaging interlocks 7, 8 are clearly apparent. The housing parts 3, 4 may be of plastic, and the interengaging snap connection thus provides for resilient, yet reliable engagement.

The plane of separation extends, as can be seen in FIG. 1, essentially transversely to the longitudinal axis of the light source. The arrangement is such that the first housing part 3 receives the socket 1 for the base of the light source, the second housing part 4 covering the light source itself.

A reflector 9 (FIG. 2) is located on the inside of the housing part 4, the housing part 4 and the reflector spanning the wider side 11 of the light source. The second housing part 4 is formed with an opening in the direction where light is to be emitted; preferably, a light transmissive or a diffusing screen 10 closes off the opening. The light transmissive or diffusing screen 10 can be securely connected to the housing part 4 or can be releasable therefrom, for example by resiliently squeezing together the diffusing screen which, then, can engage with snap hooks or projections in suitable recesses in the housing part 4.

Figure 2:
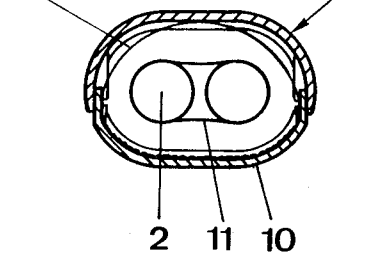
FIG. 2 is a schematic cross section along line A—A of FIG. 1.
Figure 3:
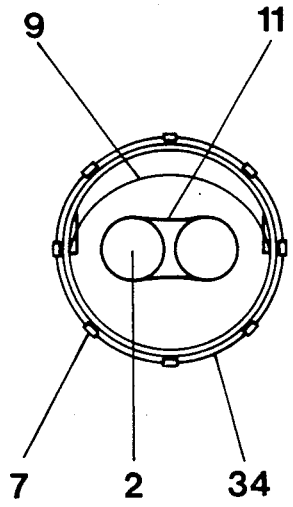
FIG. 3 is an end view taken in the direction of arrow B of FIG. 1 of another embodiment of the second housing part shielding the light source.

The cross section of the housing parts 3, 4 in the plane of separation is so selected that the second housing part 4 can be rotated at least once, for example by 180°, about the longitudinal axis of the lamp. The housing parts, then, can be snapped together in the respective positions. The ends of the housing parts 3, 4, at their engagement junction, that is, in the plane where they fit together, can be oval, as shown in FIGS. 1 and 2, permitting placement of the housing part 4 with respect to the reflector 3 in two, respectively 180° offset positions;

if the end portions of the housing parts 3, 4 are circular, as illustrated by housing part 34, FIG. 3, the housing part 34 can be placed with respect to housing part 3, at any selected position as determined, for example, by the placement of the respective recesses and projections 8, 7 on the housing parts 3, 34.

Various changes and modifications may be made within the scope of the inventive concept.

I claim:

1. Single-ended, compact fluorescent lamp (2)-socket (1) -and reflector (9) combination having a two-part housing (3, 4), support means (5, 6) connected to a first part (3) of the housing for supporting the housing in a predetermined position;

wherein the first part (3) of the housing is formed to retain a socket (1) for the fluorescent lamp (2) therein, the lamp (2) projecting from said socket;

a second part (4) of the housing is elongated and, in cross section, curved to cover, at least in part, the fluorescent lamp; and a reflective surface (9) is provided on the inside of said second part of the housing at the surface thereof facing the lamp;

said combination comprising means for selectively placing the second housing part (4) and the reflector (9) therein in a desired angular position with respect to the support means (5, 6) without disturbing the position of the lamp (2) in the socket, comprising an interlocking elastic snap-in connection (7, 8) formed on, respectively, said first and second housing parts, for separably connecting said first and second housing parts, including projections and recesses formed, respectively, on the housing parts (3, 4) and positioned for selective placement of the second housing part (4) in the first housing part (3) in a selected angular position;

said two housing parts being separable along a plane essentially transverse to the longitudinal extent of said fluorscent lamp (2), said projections and recesses being located for selective engagement in at least two different angular positions about said lamp (2) upon snap-in thereof to permit selective direction of light from the lamp (2) by the reflector (9) with respect to the position of the support means (5, 6).

2. Combination according to claim 1, wherein said single-ended fluorescent lamp has two parallel fluorescent tubes.

3. Combination according to claim 2, wherein the second housing part and the reflector (9) are shaped to form a part-oval cross section to span across the two parallel fluorescent tubes.

4. Combination according to claim 1, wherein the second housing part and the reflector therein have part-circular cross section.

5. Combination according to claim 1, wherein the projections and recesses are positioned for selective placement of the second housing part (4) in the first housing part (3) in respectively 180° rotated positions.

6. Combination according to claim 1, wherein the interlocking elastic snap-in connection comprises plastic snap hooks formed on one of said housing parts, interengaging with depressions formed on the other housing part.

7. Combination according to claim 6, wherein the plastic snap hooks are formed on the second housing part (4) and the depressions, into which the elastic plastic snap hooks engage, are formed on the first housing part (3).

* * * * *